US005671522A

United States Patent [19]

Aronne

[11] Patent Number: 5,671,522

[45] Date of Patent: Sep. 30, 1997

[54] METHOD AND APPARATUS FOR SEALING A PRESSURE VESSEL

[75] Inventor: Armand Aronne, Massapequa, N.Y.

[73] Assignee: Northrop Grumman Corporation, Los Angeles, Calif.

[21] Appl. No.: 593,666

[22] Filed: Jan. 29, 1996

[51] Int. Cl.[6] ..... B23P 17/00

[52] U.S. Cl. ..... 29/419.2; 29/511; 29/516; 29/243.517; 72/54

[58] Field of Search ..... 29/419.2, 511, 29/283.5, 773, 776, 516, 243.517, 243.57; 206/0.6; 220/581, 582, 362; 72/54; 264/405

[56] References Cited

U.S. PATENT DOCUMENTS

| | | | |
|---|---|---|---|
| 929,255 | 7/1909 | Singleton | 220/581 |
| 2,867,358 | 1/1959 | Meshberg | 29/511 |
| 2,965,964 | 12/1960 | Loew | 29/511 |
| 2,976,907 | 3/1961 | Harvey et al. . | |
| 3,326,407 | 6/1967 | Morgan et al. | 220/581 |
| 3,417,456 | 12/1968 | Carlson . | |
| 3,438,115 | 4/1969 | Humphress et al. . | |
| 3,513,531 | 5/1970 | Humphress et al. . | |
| 3,581,541 | 6/1971 | Wildi . | |
| 3,861,339 | 1/1975 | Aida et al. | 29/505 |
| 3,992,773 | 11/1976 | Duffner et al. . | |
| 4,063,208 | 12/1977 | Bernatt . | |
| 4,096,616 | 6/1978 | Coffinberry . | |
| 4,531,393 | 7/1985 | Weir . | |
| 4,561,799 | 12/1985 | Arena . | |
| 4,647,856 | 3/1987 | Melgui et al. . | |
| 4,754,177 | 6/1988 | Kirilov et al. . | |

*Primary Examiner*—David P. Bryant

*Attorney, Agent, or Firm*—Terry J. Anderson; Karl J. Hoch, Jr.

[57] ABSTRACT

A cylinder is closed to form a sealed container for gases and the like. The cylinder is closed by means of a pair of specially constructed end caps each having annular recesses formed around their circumference. The ends of the cylinders are engaged within the recess and joined by magnetic pulse forming. The magnetic pulse foxing force is asserted radially inward against a mandrel which mates with a depression formed in the caps so that the assembled cylinder and cap are squeezed into sealed relation.

7 Claims, 2 Drawing Sheets

METHOD AND APPARATUS FOR SEALING A PRESSURE VESSEL

BACKGROUND OF THE INVENTION

In pressure vessels used in aerospace applications such as oxygen bottles on aircraft, there is a critical requirement to create an effective sealed closure of the vessel. This function is accomplished by a complicated series of swaging and welding steps. The potentially catastrophic results of a leak makes this expensive and time consuming process worthwhile. Nevertheless it would be advantageous to provide a simple and effective way to seal pressure vessels for use in these applications. It is the purpose of this invention to design a closure for a pressure vessel which is suitable for sealing a pressure vessel through the use of magnetic pulse forming.

Magnetic pulse forming is a method of using a rapidly changing magnetic field to exert force on a metallic work piece. This method is an assembly technique which utilizes the interaction of an external magnetic field to the currents induced in the work piece. In this manner a reactive force can be produced between the magnetic field and the work piece which is sufficient to rapidly deform the work piece to its desired shape. A typical device for forming using this method is shown in U.S. Pat. No. 5,442,846.

SUMMARY OF THE INVENTION

A cylinder is closed to form a sealed container for gases and the like. The cylinder is closed by means of a pair of specially constructed end caps each having annular recesses formed around their circumference. The ends of the cylinders are engaged within the recess and joined by magnetic pulse forming. The magnetic pulse forming force is asserted radially inward against a mandrel which mates with a depression formed in the caps so that the assembled cylinder and cap are squeezed into sealed relation.

DESCRIPTION OF THE DRAWING

The invention is described in more detail below with reference to the attached drawing in which.

DETAILED DESCRIPTION OF THE PREFERRED EMBODIMENT

Figure 1:
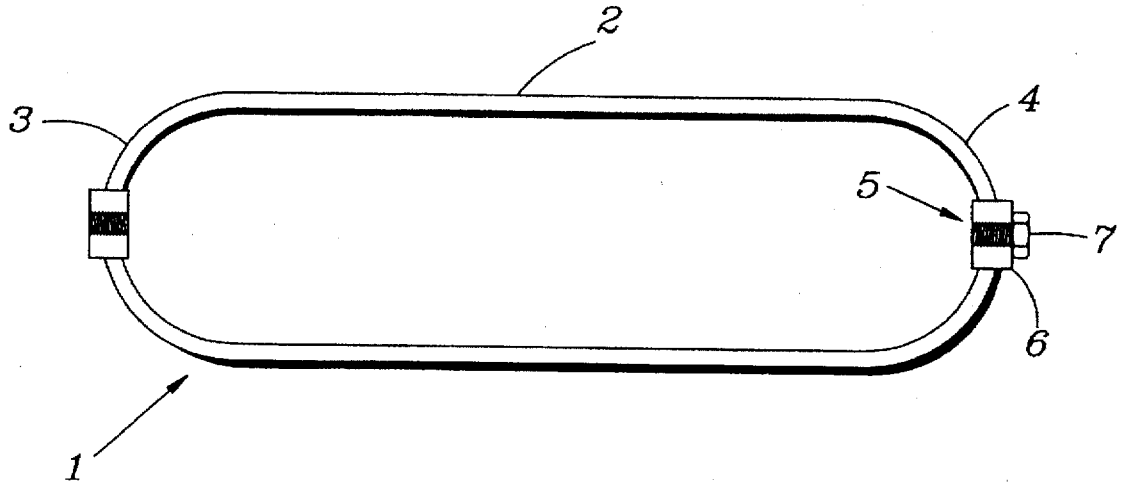
FIG. 1 (PRIOR ART)
FIG. 1 is a sectional view of a cylinder typical of the prior art.

This invention involves the construction of a container suitable for retaining pressurized gases. A complete container 1 of the prior art is shown in FIG. 1 and is constructed by swaging the ends 3 and 4 of cylindrical member 2 into mutual alignment to form a closure opening 5. The opening 5 is then closed by the insertion of a closure ring 6 which is welded in place. The closure ring 6 is constructed with an axial aligned threaded opening into which is screwed the threaded cap 7 to complete the sealed pressurized container of the prior art.

Figure 3:
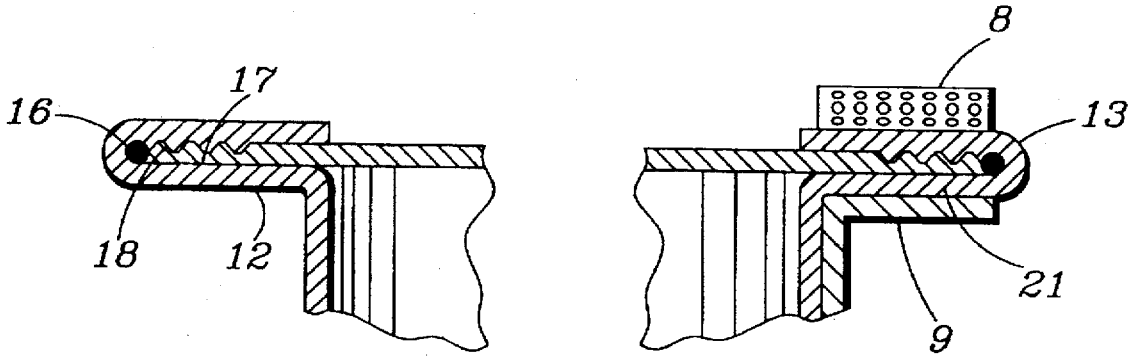
FIG. 3 is an enlarged sectional view of the sealed joint of the subject invention including the cooperative relation of the magnetic pulse forming coil and the mandrel.
Figure 2:
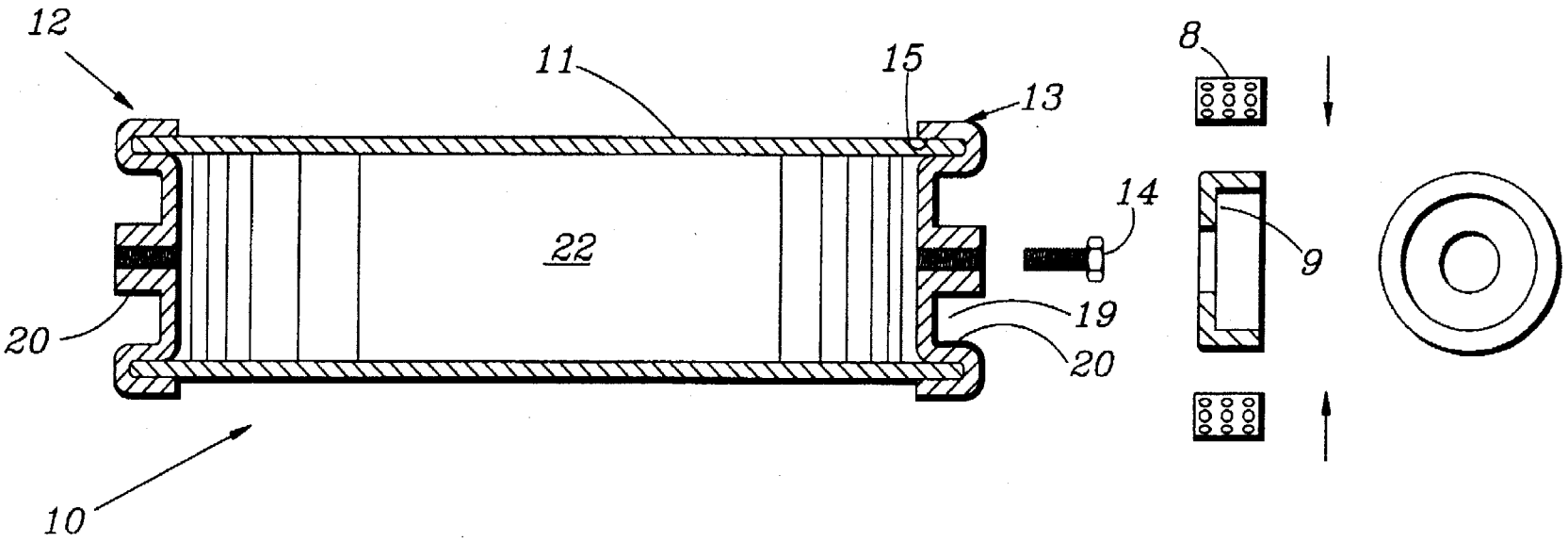
FIG. 2 is a sectional view of the cylinder of this invention and its associated forming apparatus.

The pressurized container 10 of this invention is shown in FIG. 2 and is comprised of a metal cylinder 11, end closures 12 and 13, and threaded cap 14. The end closures 12 and 13 are joined to the cylinder 11 by means of the forces exerted by the magnetic pulse forming coil 8 in cooperation with the mandrel 9 as best shown in FIG. 3.

As is Shown in FIG. 2, the cylinder 11 may be constructed of any suitable metal tubing having the required strength and forming characteristics for the particular application. The closure members 12 and 13 are formed of similar materials but need to be magnetic in nature to allow for the induction of a current in the closure to facilitate the magnetic pulse forming process. Each closure is formed with an annular recess 15 having a width and circumference which matches that of the end of the cylinder 11. The recess 15 receives the end of cylinder 11 in the assembled position. To enhance the sealing function a resilient, o-ring 16 is installed in the recess 15 prior to its engagement with the end of cylinder 11. In addition, to strengthen the joint it is desirable that at least one of the interior surfaces 17 of the recess 15 be constructed with serrations or grooves 18. Each of closures 12 and 13 is constructed with a threaded opening into which is screwed the plug or cap 14. The completed assembly defines an interior chamber 22 suitable for containing pressurized gases.

In order to create the required force to join the parts of the pressure vessel of this invention, a high magnetic flux density must be generated around the periphery of the joint. To accomplish this a magnetic pulse forming coil 8 is placed over the circumference of the assembled joint of cylinder 11 and closures 12 and 13 as shown in FIGS. 2 and 3. The coil 8 is connected to a source of electric voltage preferably through a high discharge capacitor, not shown. This allows a rapidly changing magnetic flux to be generated and focused at the joint. The rapidly decaying flux will generate a similarly decaying current in the material of the closure 12. The resulting reaction flux causes large repulsion forces to act on the joint in a radially inward direction.

To further enhance the pulse forming operation, the closures 12 and 13 are formed with annular shaped, exterior facing, recesses 19 within their outer surfaces 20. The external recess 19 accommodates the cylindrical mandrel 9 5 which engages the joint at a radially inward position which is opposite to the coil 8. In this manner the magnetic pulse forming forces tend to squeeze the joint from each side to form an effective sealed joint. To insure the effective opposition of the pulse forming force and the reactive force of the mandrel, the external recess 19 is displaced radially inward from the cylinder engaging recess 15. In this manner the recesses 15 and 19 extend substantially parallel and are separated by the common wall 21 of the shaped structure of the closures 12 and 13 as shown in FIGS. 2 and 3.

In this manner, a strong effective joint is constructed to complete the pressure vessel of this invention without the need for repeated swaging and welding steps with their inherent complexities.

I claim:

1. A method of constructing a container having an interior chamber suitable for retaining pressurized fluids comprising:

forming a hollow cylindrical body having opposing first and second open ends, each of said ends having circular edges;

forming first and second end closures each having an annular recess constructed to receive the first and second ends of the cylindrical body in a mating relation, said first and second end closures being manufactured of a material capable of sustaining an induced magnetic field, each of said recesses being formed as a slot defined by a circular base and cylindrical side walls, said slot opening towards the interior chamber;

engaging the first and second end closures on the first and second ends of the cylindrical body to form an assembled container having an enclosed inner chamber, said engagement accomplished by inserting the circular edge of each of said first and second ends of the cylindrical body into the slot of the end closure until the edge substantially seats on the base of the slot and the sides of the slot engage the cylindrical body;

surrounding each of the engaged assemblies of said first and second ends of the cylindrical body and said first and second end closures with an electrically conductive coil; and applying a pulse of current to the coil to create a magnetic field to generate a force on each of the engaged assemblies sufficient to magnetically pulse form said assemblies into a sealed joint.

2. A method of constructing a container having an interior chamber suitable for retaining pressurized fluids as described in claim 1, further comprising the step of inserting an o-ring into the slot at said base prior to engagement of the closure with the cylindrical body to provide a resilient seat for the edge of the cylindrical body and to enhance the sealing of the joint.

3. A method of constructing a container having an interior chamber suitable for retaining pressurized fluids as described in claim 1, further comprising the step of constructing grooves on the side walls of the slot of each of said first and second end closures to enhance the structure of the joint.

4. A method of constructing a container having an interior chamber suitable for retaining pressurized fluids as described in claim 1 further comprising:

forming a second recess in said first and second end closures facing away from the interior chamber, said second recess defined by an annular base and a cylindrical side wall, wherein said side wall of the second recess is radially inward from the side wall of the slot and substantially coextensive therewith;

constructing a mandrel shaped for engagement with the side wall of the second recess; and inserting the mandrel into the second recess in a position to oppose the force of the pulse forming magnetic field, to squeeze the side walls of the slot into sealing engagement with the cylindrical body.

5. Apparatus for sealing a container having an interior chamber suitable for retaining pressurized fluids comprising:

a hollow cylindrical body having opposing first and second open ends, each of said ends having circular edges;

first and second end closures each having an annular recess constructed to receive the first and second ends of the cylindrical body in a mating relation, said first and second end closures manufactured of a material capable of sustaining an induced magnetic field, each of said recesses comprising a slot defined by a circular base and cylindrical side walls, said slot opening towards the interior chamber, said end closures engaged on the first and second ends of the cylindrical body to form a joint in which the circular edge of each of said first and second ends of the cylindrical body seat on the base of the slot and the sides of the slot engage the cylindrical body;

a coil of electrically conductive wire removably wrapped about the joint and connected to a source of electrical power to generate a magnetic field suitable for inducing a current within the first and second end closures, said magnetic field and said induced current interacting to create magnetic pulse forming forces on the first and second end closures to form a joint and seal the interior chamber;

a second recess formed in each of said first and second end closures facing away from the interior chamber, said second recess defined by an annular base and a cylindrical side wall, wherein said side wall of the second recess is radially inward from the side wall of the slot and substantially coextensive therewith; and a mandrel shaped for engagement with the side wall of the second recess, said mandrel engaged into the second recess in a position to oppose the force of the pulse forming magnetic field and to squeeze the side walls of the slot into sealing engagement with the cylindrical body.

6. Apparatus for sealing a container having an interior chamber suitable for retaining pressurized fluids as described in claim 5, further comprising an o-ring mounted at the base of the slot to provide a resilient seat for the edge of the cylindrical body and enhance the sealing of the joint.

7. Apparatus for sealing a container having an interior chamber suitable for retaining pressurized fluids as described in claim 5, further comprising grooves on the side walls of the slot of each of said first and second end closures to enhance the structure of the joint.

* * * * *